US005510021A

United States Patent [19]

Potthast

[11] Patent Number: 5,510,021

[45] Date of Patent: Apr. 23, 1996

[54] PORTABLE BUOYANT SKIMMING APPARATUS FOR SWIMMING POOLS

[76] Inventor: William K. Potthast, 5114 E. 127th Ave., Tampa, Fla. 33637

[21] Appl. No.: 375,495

[22] Filed: Jan. 19, 1995

[51] Int. Cl.[6] ..... E04H 4/12

[52] U.S. Cl. ..... 210/169; 210/232; 210/242.1

[58] Field of Search ..... 210/169, 232, 210/242.1, 249, 409, 456, 776; 4/490, 496, 512

[56] References Cited

U.S. PATENT DOCUMENTS

| | | | |
|---|---|---|---|
| 3,152,076 | 10/1964 | Kreutzer . | |
| 3,244,284 | 4/1966 | Shaffer . | |
| 3,625,364 | 12/1971 | La Chance | 210/169 |
| 3,774,767 | 11/1973 | Field . | |
| 4,068,327 | 1/1978 | Heinlein | 210/169 |
| 4,221,662 | 9/1980 | Joseph | 210/169 |
| 4,379,749 | 4/1983 | Roth . | |
| 4,455,695 | 6/1984 | Mikhel . | |
| 4,720,340 | 1/1988 | O'Brien . | |
| 4,734,189 | 3/1988 | Page, Jr. . | |
| 4,781,827 | 11/1988 | Shields . | |
| 4,789,470 | 12/1988 | Wards . | |
| 4,904,379 | 2/1990 | Ward . | |
| 4,960,514 | 10/1990 | Paskert | 210/169 |
| 5,059,314 | 10/1991 | Beckman . | |
| 5,085,767 | 2/1992 | Beers . | |
| 5,128,031 | 7/1992 | Midkiff . | |
| 5,264,122 | 11/1993 | Lakotish . | |
| 5,277,801 | 1/1994 | Lundquist . | |
| 5,336,400 | 9/1994 | Patrice | 210/169 |
| 5,391,296 | 2/1995 | Rotundo et al. | 210/169 |

*Primary Examiner*—Peter A. Hruskoci
*Assistant Examiner*—Theodore M. Green
*Attorney, Agent, or Firm*—Marshall & Melhorn

[57] ABSTRACT

A portable buoyant skimming apparatus for removing surface debris from a swimming pool. The skimming apparatus is positioned on the water surface of a pool near the inlet of the pool's filtration system. The water current from the filtration system carries surface debris into the buoyant skimming apparatus whereby the debris is directed into the filtration inlet. The light weight and portable skimming apparatus is made with tubular members so that the water carried into the apparatus moves under the tubular members while the floating debris remains at the surface. The skimming apparatus is easily installed and removed from the pool.

14 Claims, 1 Drawing Sheet

FIG. 1
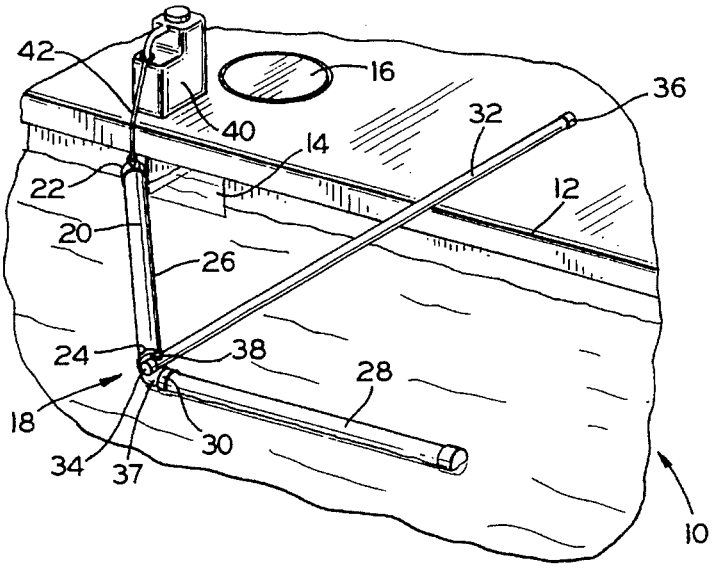
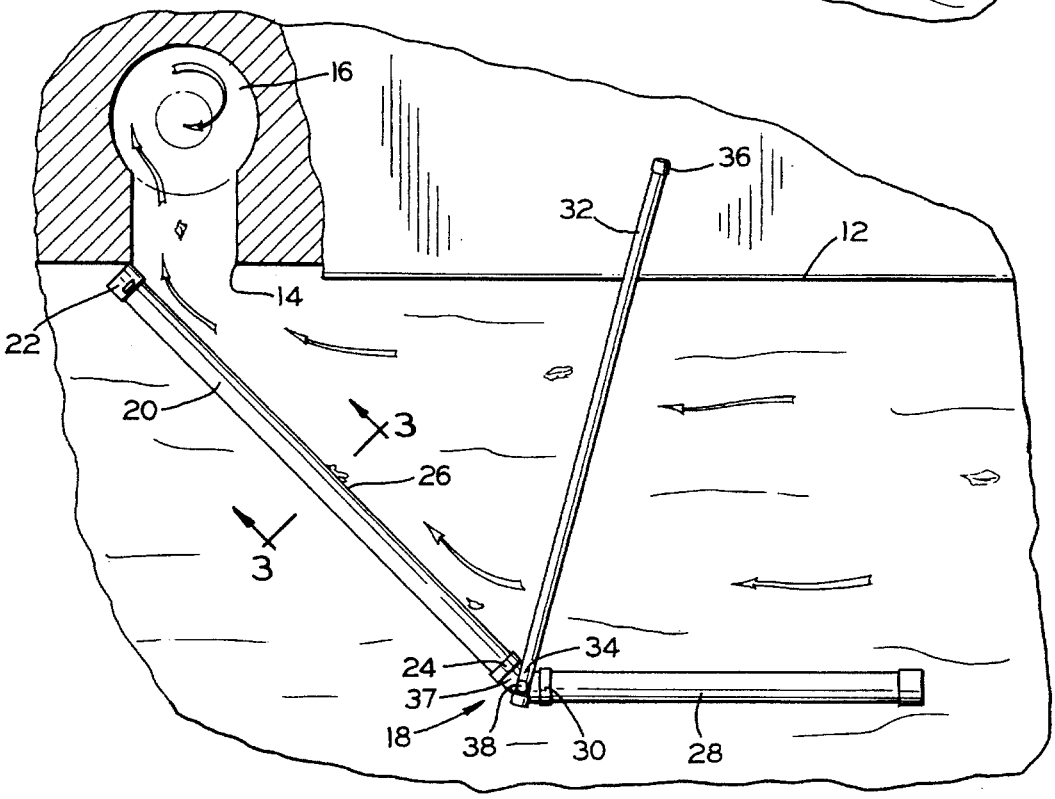
FIG. 2
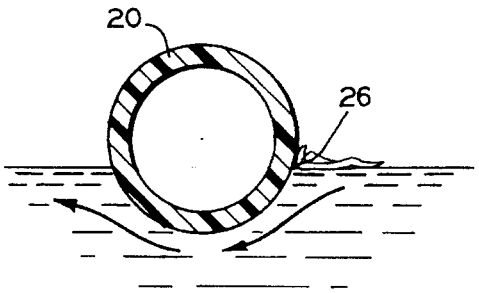
FIG. 3
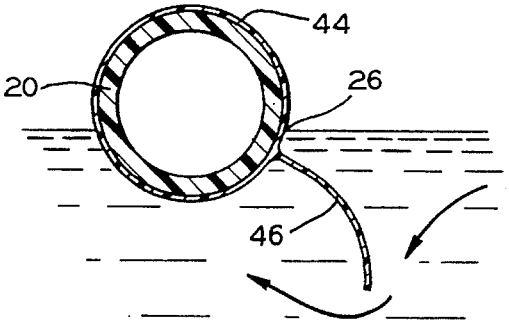
FIG. 4

PORTABLE BUOYANT SKIMMING APPARATUS FOR SWIMMING POOLS

BACKGROUND OF THE INVENTION

1. Field of the Invention

This invention relates to cleaning equipment for a swimming pool and more particularly to a portable buoyant skimming apparatus designed to remove surface debris by directing the debris towards the inlet of the pool's filtration system.

2. Summary of Related Art

Removal of dirt and debris from swimming pools is a constant problem. The majority of the contaminants enter the pool through the surface where they float for a relatively short period before they sink to the bottom of the pool. Consequently, pools require regular cleaning to remove contaminants from the bottom of the pool.

Conventional swimming pools attempt to remove surface debris through filtration systems. A filtration device circulates pool water via a pumping system through a filtration inlet, located at the surface level, through a filter and back into the pool. The discharge of the pump into the pool is oriented to create a current or flow around the perimeter of the pool towards the filtration inlet. The flow pushes surface debris towards the filtration inlet where the debris is entrained and removed.

The filtration systems are not always effective in removing all of the surface debris from the pool. The problem stems from the fact that the inlet is usually perpendicular to the current flow and is narrow and does not cover a large surface area. Therefore, most surface debris does not enter the inlet of the filtration system and remains in the pool. The debris, if not removed by manually skimming, eventually sinks to the bottom of the pool. The pool will then require additional cleaning which is often very labor intensive.

Diverter devices for improving the skimming function in swimming pools are known. The diverter devices, placed near the filtration inlet of the pool, generally employ a mechanical arm extending horizontally into the flow of the circulating pool water. The current carries the floating debris into the mechanical arm of the device. The angle of the apparatus in combination with the current forces the floating debris along the mechanical arm and into the filtration inlet where it is then entrained and subsequently removed.

Most of the devices are fastened onto the side wall of the pool or onto the filtration inlet by a fixed mechanical means. The mechanical fastening devices require additional structural changes to the side wall of the pool or the filter inlet. They also create a potential hazard with additional hardware extending into the swimming area.

The diverter devices generally use a mechanical arm with a front edge having a vertical surface for directing the floating debris. The vertical surface is positioned at the surface of the water and is partially immersed to guide the debris in the filtration inlet. Most of the devices utilize a vertical surface in the form a metal bar while others attach a vertical surface onto an additional element. The majority of these devices require extensive fabrication and are not light weight and portable.

U.S. Pat. No. 3,152,076 issued to Kreutzer discloses a filter system which circulates the water in the pool. A straight wand device is secured to the side of the pool and floats on the surface of the water to direct debris into the inlet of the filter system. A special mounting bracket and shank are used to secure the wand to the side of the pool.

U.S. Pat. No. 3,774,767 issued to Field shows a buoyant member having laterally angled inner and outer ends. A cord and a small weight are used to secure the device to the side of the pool. The buoyant member is formed by a cylindrical tube having a vertical planar strip affixed to the side to direct the debris into the inlet.

U.S. Pat. No. 4,455,695 issued to Mikhel discloses an alternative configuration for a skimming device. The guide bar has a rectangular cross section. The bar is maintained in the desired position by a pair of tie bars secured between the guide bar and the side of the pool.

U.S. Pat. No. 4,720,340 issued to O'Brien discloses a skimming device with a floating blade and a support rod. One end of the blade is positioned in the corner of the inlet and the other is supported in the water by the rod. The rod is provided with a weighted mounting means to secure the rod to the pool.

The prior art inventions generally disclose a skimming apparatus for directing debris into the filtration inlet. However, most of the devices utilize a fixed means at the filtration inlet to secure a mechanical arm. Most of the devices use a vertical edge to direct the debris into the filtration inlet. These devices generally require some detailed fabrication of the apparatus or fabrication at the side of the pool in order to provide the vertical edge or a fixed mechanical securing means.

It would be advantageous to have a portable buoyant skimming apparatus which is easily set up and removed and which improves the skimming capability of a pool's filtration system. Furthermore, it would be a benefit to have a device that is easily fabricated from low cost standard materials of construction and installed without requiring any modifications to the pool.

SUMMARY OF THE INVENTION

In accordance with the present invention, there is provided a portable buoyant skimming apparatus for removing surface debris from a swimming pool. The apparatus includes two elongate members constructed of a light weight buoyant material. A first elongate member is provided with an inlet end, a junction end, and a debris edge. The debris edge extends longitudinally along the first member and directs floating debris toward the inlet end.

A second elongate member is attached to the junction end of the first elongate buoyant member at an obtuse angle. The inlet end of the first elongate buoyant member is temporarily secured at the pool wall near the inlet of the filtration system.

An elongate support member pivotly connects to the junction of the first and second members. The elongate support member is equal to or greater in length than the first member such that the free end of the support member may be used to position and support the apparatus from the side of the pool. The support member may be moved to an open position at an acute angle to the first member or to a closed position parallel with the first member. When the elongate support member is in an open position, the apparatus may be placed in the pool and the free end of the support member can engage the top edge of the pool. This temporarily secures the apparatus in place in the pool.

The apparatus directs floating debris circulated by the pool's filtration system along the debris edge of the first member and into the filtration inlet. When the skimming is completed, the apparatus may be removed and the support bar moved to the closed position for storage.

The objective of the present invention is to provide a portable low cost skimming apparatus which improves the skimming capability of a pool's filtration system. The apparatus is light weight and portable such that an individual can easily install and remove the skimming apparatus from the pool.

A further objective is to eliminate the need for attaching the present invention to the side of the pool by a fixed mechanical means. The tubular design of the present invention reduces the force exerted by the water against the present invention. The reduced force eliminates the need for attaching the invention by a fixed mechanical means.

Another objective is to produce the apparatus from low cost standard materials in a manner which does not require extensive fabrication.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a perspective view of the skimming apparatus as it is positioned for use in a pool.

FIG. 2 is a top elevation view of the skimming apparatus in use with arrows indicating the path the floating debris will follow.

FIG. 3 is a cross sectional view along line 1—1 of the first elongate member indicating the debris edge.

FIG. 4 is a cross sectional view of the first elongate buoyant member having an enhanced debris edge formed by a plastic sheet.

DESCRIPTION OF THE PREFERRED EMBODIMENT

Referring now more particularly to the drawings, there is illustrated in FIGS. 1 and 2 a swimming pool 10 filled with water. The swimming pool 10 has a side wall 12 with a filtration inlet 14 in the side wall 12 positioned at the water level of the pool 10. The skimming apparatus 18 is positioned in the pool 10 near the filtration inlet 14 in order to sweep floating debris into the filtration inlet 14.

The skimming apparatus 18 is made up of a first elongate buoyant member 20, a second elongate buoyant member 28, and an elongate support member 32. The first elongate buoyant member has an inlet end 22, a junction end 24, and a debris edge 26. The inlet end 22 contacts the side wall of the pool 12. The first elongate buoyant member 20 extends into the current at an acute angle from the side wall of the pool 12. The debris edge 26 is created on the current side along the longitudinal surface of the first elongate member 20.

The second elongate buoyant member 28 has a junction end 30 which is coupled to the junction end 24 of the first elongate member 20 at an obtuse angle. The two elongate buoyant members 20 and 28 are connected in the same plane by an angled elbow connector 37. The preferred angle is about 120 degrees. This angle allows for the proper extension of the second elongate buoyant member 28. The angle also provides a steep enough acute angle on the first elongate buoyant member 20 to allow the debris which collects upon the debris edge 26 to flow towards and into the filtration inlet 14.

The elongate support member 32 includes a pivot end 34 connected at the junction of the first elongate buoyant member 20 and the second elongate buoyant member 28 by a pivotable connector 38. The pivotable connector 38 allows the elongate support member 32 to move freely to an open position where the elongate support member 32 is at an acute angle to the first elongate buoyant member 20, or a closed position where the elongate support member 32 is parallel with the first elongate buoyant member 20.

The preferred materials of construction are poly-vinyl chloride pipe having a diameter range of 2–4 inches. The poly-vinyl chloride pipe is light weight and inexpensive. The diameter range of the pipe must be large enough to create a buoyant member extending high enough above the water line to create a sufficient debris edge 26. poly-vinyl chloride end caps enclose the first and second elongate members 20, 28 and seal their respective ends. The elongate support member 32 is also constructed with poly-vinyl chloride pipe. The diameter of the elongate support member 32 does not need to be the same size as the first and second elongate buoyant members 20,28. Other light weight materials of construction which can create a buoyant round member are suitable as well.

The debris edge 26 can be optionally enhanced by wrapping the perimeter of the first elongate buoyant member 20 in a plastic sheet 44 as illustrated in FIG. 4. An excess portion of the sheet extends from the first elongate buoyant member 20 to form a lip 46. The lip 46 extends into the water at an acute angle to create an extension of the debris edge 26 below the water surface.

The junction ends 24 and 30 of the elongate members 20 and 28 are joined by a standard poly-vinyl chloride elbow connector 37. Other connectors will function as well as long as the preferred obtuse angle is obtained. This includes angled ends for the elongate members 20 and 28 where the junction ends 24 and 30 are integrally connected.

There are several variables which effect the size and length of the elongate buoyant members 20 and 28. The length of the elements depend upon the size of the pipe, the size of the pool, the shape of the pool, and the strength of the current from the filtration system. The elements must extend outward into the pool in order to provide a sufficient sweep to collect floating debris. The elements must also withstand the force of the current generated from the filtration system.

The skimming apparatus 18 is temporarily held in place by securing the inlet end 22 of the skimming apparatus 18 to the side wall 12. FIG. 1 shows a weighted object 40 positioned on top of the side wall 12. A fastening rope 42 is connected to the inlet end 22 of the first elongate buoyant member 20 and to the weighted object 40.

The weighted object 40 can be a hollow container filled with weighted material. Any flowable material, such as water, sand, or stone, is suitable to provide weight for the container. Pool water is preferred as it can be poured back into the pool after use and thereby reduce the overall weight of the entire apparatus thus making it easier to store away.

Having set forth a description of the structure of the present invention, its use and function may now be described with particular reference to FIG. 2. The skimming apparatus 18 is placed in the pool 10 near the filtration inlet 14. The skimming apparatus 18 extends outward across the water surface of the pool 10. The inlet end 22 of the first elongate member 20 abuts the side wall 12 near the filtration inlet 14.

The first elongate buoyant member 20 extends outward at an acute angle from the side wall 12 into the current generated by the filtration system. The second elongate buoyant member 28 is therefore positioned longitudinally with the oncoming current. The second elongate buoyant member 28 provides buoyancy for the junction end 24 of the first elongate buoyant member 20 an assists in directing floating debris into the debris edge 26 of the first elongate buoyant member 20.

The elongate support member 32 is placed in an open position at an acute angle to the first elongate buoyant member 20. The acute angle is about 60 degrees. The free end 36 of the elongate support member 32 temporarily engages the top of the side wall 12 and secures the skimming apparatus 18 in place. In general, a weighted means is not required at the free end 36 to secure the elongate support member 32. The friction should be enough to over come the force of the current and maintain the appropriate position of the skimming apparatus 18. However, pools and side walls vary and therefore it may be necessary to add a weighted means on at the free end of the elongate support member 32. A weighted means, similar to the one used at the inlet end 22 of the first elongate member 20, is suitable for use with the free end 36.

Debris floating on the water surface is circulated around the pool by the current generated from the filtration system. FIG. 2 illustrates the skimming apparatus in use with direction arrows indicating the path of the surface debris. As the debris approaches the skimming apparatus 18, the debris is directed into the first elongate buoyant member 20 by the current and by the second elongate buoyant member 28. The debris collects upon the debris edge 26 of the first elongate buoyant member 20. The water passes under the first elongate buoyant member 20 while the debris remains on the debris edge 26. FIG. 3 is a cross sectional view illustrating the water passing under the first elongate buoyant member 20 while the debris remains at the surface.

The rounded pipe allows the water to pass under the first elongate buoyant member 20 while collecting the debris along the debris edge 26. The rounded pipe also reduces the skimming apparatus' resistance to the force of the current and thereby reduces the need for a fixed attachment or heavy weighted means.

In FIG. 4, the lip 46 formed by the optional plastic sheet 44 enhances the debris edge 26 while allowing the water to pass under the first elongate buoyant member 20 without a great amount of resistance. The enhanced debris edge extends below the water surface and prevents floating debris from being carried by the current under the first elongate buoyant member 20.

The current, in conjunction with the acute angle of the first elongate buoyant member 20, pushes the debris along the debris edge 26 and into the filtration inlet 14. The debris is then entrapped in the filter 16 of the filtration system where it then can be removed.

Upon removal of the surface debris, the skimming apparatus 18 is easily removed from the pool 10 by releasing the fastening rope 42 from the weighted object 40 and lifting the skimming apparatus 18 from the pool 10. The elongate support member 32 is rotated to a closed position so that the skimming apparatus 18 can be easily stored.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A portable skimming apparatus to remove surface debris from a swimming pool filled with water having a circulating water filtration system with a filtration inlet located in a pool wall, said skimming apparatus comprising:

(a) A first elongate buoyant member having an inlet end, a junction end, and a debris edge extending longitudinally along said first member;

(b) A second elongate buoyant member having a junction end coupled to the junction end of said first member to planarly connect said first and second members at an obtuse angle;

(c) A means for temporarily securing the inlet end of said first member to the pool wall at the filtration inlet; and (d) An elongate support member having a fixed end pivotly connected to the junction end of said first member, said elongate support member having a free end to facilitate movement of said support member from a closed position parallel to said first member to an open position at an acute angle to said first member, the free end temporarily engaging the top edge of the pool wall whereby said elongate support member may be moved to an open position to temporarily secure the skimming apparatus in the pool and direct floating debris circulated by the filtration system along the debris edge of said first member to the filtration inlet, and whereby said elongate support member may be moved to a closed position to facilitate the removal and storage of the skimming apparatus.

2. A portable buoyant skimming apparatus as recited in claim 1, wherein said first and second elongate buoyant members and said elongate support member are made from poly-vinyl chloride pipe.

3. A portable skimming apparatus as recited in claim 2, wherein said poly-vinyl chloride pipe for said first and second elongate buoyant members has a diameter range of 2–4 inches.

4. A portable buoyant skimming apparatus as recited in claim 1 wherein the obtuse angle is approximately 120 degrees and the acute angle is approximately 60 degrees.

5. A portable skimming apparatus as recited in claim 1, including a discrete coupling means positioned between the first and second elongate buoyant members for connecting the junction ends of said first and second elongate buoyant members.

6. A portable skimming apparatus as recited in claim 1, wherein said elongate support member is equal to or greater in length than said first elongate buoyant member.

7. The portable buoyant skimming apparatus as cited in claim 1, wherein said first elongate buoyant member and said second elongate buoyant member are integrally connected.

8. A portable skimming apparatus to remove surface debris from a swimming pool filled with water having a circulating water filtration system with a filtration inlet located in a pool wall, said skimming apparatus comprising:

(a) A first elongate buoyant member having an inlet end, a junction end, and a debris edge extending longitudinally along said first member;

(b) A second elongate buoyant member having a junction end;

(c) An angled coupling means connecting the junction end of said first member to the junction end of said second member, said angled coupling means positioned between said first and second buoyant members at an obtuse angle of about 120 degrees;

(d) A means for temporarily securing the inlet end of said first member to the pool wall at the filtration inlet; and (e) An elongate support member having a fixed end pivotly connected to the junction end of said first member, said elongate support member having a free end to facilitate movement of said elongate support member from a closed position parallel to said first member to an open position at an acute angle of about 60 degrees to said first member, the free end temporarily engaging the top edge of the pool wall whereby said elongate support member may be moved to an open position to temporarily secure the skimming apparatus in the pool and direct floating debris circulated by the filtration system along the debris edge of said first member to the filtration inlet, and whereby said elongate support member may be moved to a closed position to facilitate the removal and storage of the skimming apparatus.

9. A portable skimming apparatus as recited in claim 8, wherein said first and second elongate buoyant members and said elongate support member are made from poly-vinyl chloride pipe.

10. A portable skimming apparatus as recited in claim 9, wherein said poly-vinyl chloride pipe for said first and second elongate buoyant members has a diameter range of 2–4 inches.

11. A portable skimming apparatus as recited in claim 8, wherein said elongate support member is equal to or greater in length than said first elongate buoyant member.

12. A portable skimming apparatus as recited in claim 8, wherein the first elongate buoyant member is wrapped in a plastic sheet, said sheet having an excess which forms a lip, said lip extends below the water surface to create an extension of the debris edge.

13. A portable skimming apparatus as recited in claim 8, wherein said means for temporarily securing the inlet end of said first elongate buoyant member includes a hollow container filled with weighted material.

14. A portable skimming apparatus as recited in claim 8, wherein the free end of said elongate support member is temporarily secured to the pool wall by a hollow container filled with weighted material.

* * * * *